US007696990B2

(12) United States Patent
Wang et al.

(10) Patent No.: US 7,696,990 B2
(45) Date of Patent: Apr. 13, 2010

(54) LED DRIVING CIRCUIT AND A SERIAL LED ILLUMINATION SYSTEM USING THE SAME

(75) Inventors: Bily Wang, Hsin Chu (TW); Hui-Chung Lin, Chia I Hsien (TW)

(73) Assignee: Harvatek Corporation, Hsin Chu (TW)

( * ) Notice: Subject to any disclaimer, the term of this patent is extended or adjusted under 35 U.S.C. 154(b) by 932 days.

(21) Appl. No.: 11/476,120

(22) Filed: Jun. 28, 2006

(65) Prior Publication Data

US 2008/0002017 A1 Jan. 3, 2008

(51) Int. Cl.
*G09G 5/00* (2006.01)

(52) U.S. Cl. ..... 345/211; 345/102; 345/602; 345/582

(58) Field of Classification Search ..... 345/211, 345/582, 602, 102
See application file for complete search history.

(56) References Cited

U.S. PATENT DOCUMENTS

2002/0030691 A1* 3/2002 McKnight et al. ..... 345/602
2003/0011609 A1* 1/2003 Deering et al. ..... 345/582
2005/0017965 A1* 1/2005 Morita et al. ..... 345/211
2006/0158444 A1* 7/2006 Huang ..... 345/211
2006/0274024 A1* 12/2006 Wey et al. ..... 345/102
2007/0146149 A1* 6/2007 Abe et al. ..... 340/622

* cited by examiner

*Primary Examiner*—Amare Mengistu
*Assistant Examiner*—Joseph G Rodriguez
(74) *Attorney, Agent, or Firm*—Rosenberg, Klein & Lee

(57) ABSTRACT

The present invention relates to an LED driving circuit and a serial LED illumination system. The LED driving circuit compares a data signal with a voltage threshold via a comparator to output a mode selection signal. The register unit includes an instruction register and a data register. The register unit is coupled to the comparator unit and controlled by the mode selection signal to perform an instruction or data transmission mode. The instruction register stores the instruction data under the instruction mode. The data register stores the illumination display data under the data transmission mode. When the data register is full, the register unit outputs a secondary data signal. The driving unit is controlled by the instruction data and drives an LED module according to the illumination display data. The serial LED illumination system includes a controller that is connected with at least one LED driving circuit in serial.

14 Claims, 5 Drawing Sheets

LED DRIVING CIRCUIT AND A SERIAL LED ILLUMINATION SYSTEM USING THE SAME

BACKGROUND OF THE INVENTION

1. Field of the Invention

The present invention relates to an LED driving circuit and a serial LED illumination system using the same. In particular, this invention relates to an LED driving circuit and a serial LED illumination system using the same that can be operated at an AC voltage source and judges the input data signals via a comparator.

2. Description of the Related Art

As the technology that is the basis for electrical power and illumination systems has been developed, the power source for the illumination systems has become less restricted to natural power sources. Moreover, as the electronic industry has also developed, illumination methods using electrical power as the light source have become controllable. Therefore, a variety of illumination systems have been developed, including night illumination systems and decorative illumination systems having visual effects, such as neon lamps, laser lamps, and LED lamps, etc. A characteristic of decorative illumination systems is that the lamp can be patterned. Furthermore, by installing illumination lamps at the outside of a building, the outline of the building can be displayed via the light emitting from the lamps. The ensuing scene can be quite magnificent.

Recently, technological improvements have enabled LEDs to have reduced power consumption, a longer user life and add more colors to their range when used for decorative lighting displays. The LED is an illumination device in which the emitting light is visible and its bandwidth is narrow. When the diode is forward conducted, the hole carrying the carrier is combined with the electron so as to convert the potential energy into light energy. Because the LED has a low power consumption and is durable, the damage rate of its components is low. LEDs having a variety of colors have been developed. Therefore, many LEDs having a variety of colors can be composed to generate a lot of colored lights. Moreover, the light emitting from the LED is bright and stable, and its switching speed is higher than that of photogenes, so a continuous colorful imaging can be displayed. Therefore, LEDs are extensively used as lighting elements for large-sized displays, dynamic image displays or decorative illumination systems.

Reference is made to FIG. 1, which shows a circuit block diagram of an LED driving circuit of the prior art. The LED driving circuit 10 includes a shift register 102 and a driving unit 104. The shift register 102 stores the display data signals Data according to the clock signal Clock. The driving unit 104 is controlled by the data latch signal Latch and drives a full color LED to emit according to the display data signals Data stored in the shift register 102. When the shift register 102 is full, the shift register 102 outputs the display data signals that are not stored to a next LED driving circuit 10 that is connected in serial.

Reference is made to FIG. 2, which shows a block diagram of a serial LED illumination system of the prior art. The illumination system 1 is composed of a plurality of LED driving circuits 10, 12, 1*n* that are connected to each other in serial. The LED driving circuits 10, 12, 1*n* receives a DC VDD simultaneously. In the illumination system 1 of the prior art, each of the LED driving circuits 10, 12, 1*n* needed to receive a clock signal Clock, a display data signal Data, a data latch signal Latch, or other signals So etc.

In the illumination system 1 of the prior art, a new transmission line must be added whenever a new function is added. Therefore, the transmission lines of the illumination system become complex and it is difficult to maintain the circuit. Moreover, because each of the LED driving circuits in the illumination system 1 obtains power from the same DC VDD, the voltage in the serial LED illumination system becomes decayed. Therefore, the rear LED driving circuits can obtain a stable power from the DC VDD.

SUMMARY OF THE INVENTION

One particular aspect of the present invention is to provide an LED driving circuit and a serial LED illumination system using the same. The LED driving circuit used in the illumination system utilizes a rectification unit and a power supply unit as so to be operated in an AC, thereby avoiding supply voltage decay. The LED driving circuit uses the comparator to judge the inputted data signal. By increasing the number of comparators in the LED driving circuit, the number of transmission lines is decreased.

The LED driving circuit of the present invention includes a comparator unit, a register unit, and a driving unit. The comparator unit has at least one voltage threshold. The comparator unit compares a data signal with the voltage thresholds so as to output a mode selection signal. The data signal is an instruction data or an illumination display data. The register unit includes an instruction register and a data register. The register unit is coupled to the comparator unit. The register unit is controlled by the mode selection signal and performs an instruction mode or a data transmission mode according to a clock signal. The instruction register stores the instruction data under the instruction mode. The data register stores the illumination display data under the data transmission mode. When the data register is full, the register unit outputs a secondary data signal. The driving unit is coupled with the register unit. The driving unit is controlled by the instruction data and drives an LED module according to the illumination display data.

The serial LED illumination system of the present invention includes a controller and at least one LED driving circuit. The controller outputs a data signal. The data signal is an instruction data or an illumination display data. The LED driving circuits are connected with each other in serial and coupled to the controller. The LED driving circuit receives the data signal according to a clock signal. When the serial LED illumination system of the present invention is operated in an instruction mode, the LED driving circuits stores the instruction data simultaneously via a parallel data transmission method. When the serial LED illumination system of the present invention is operated in a data transmission mode, the LED driving circuits transmits a secondary data signal via a serial data transmission method.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
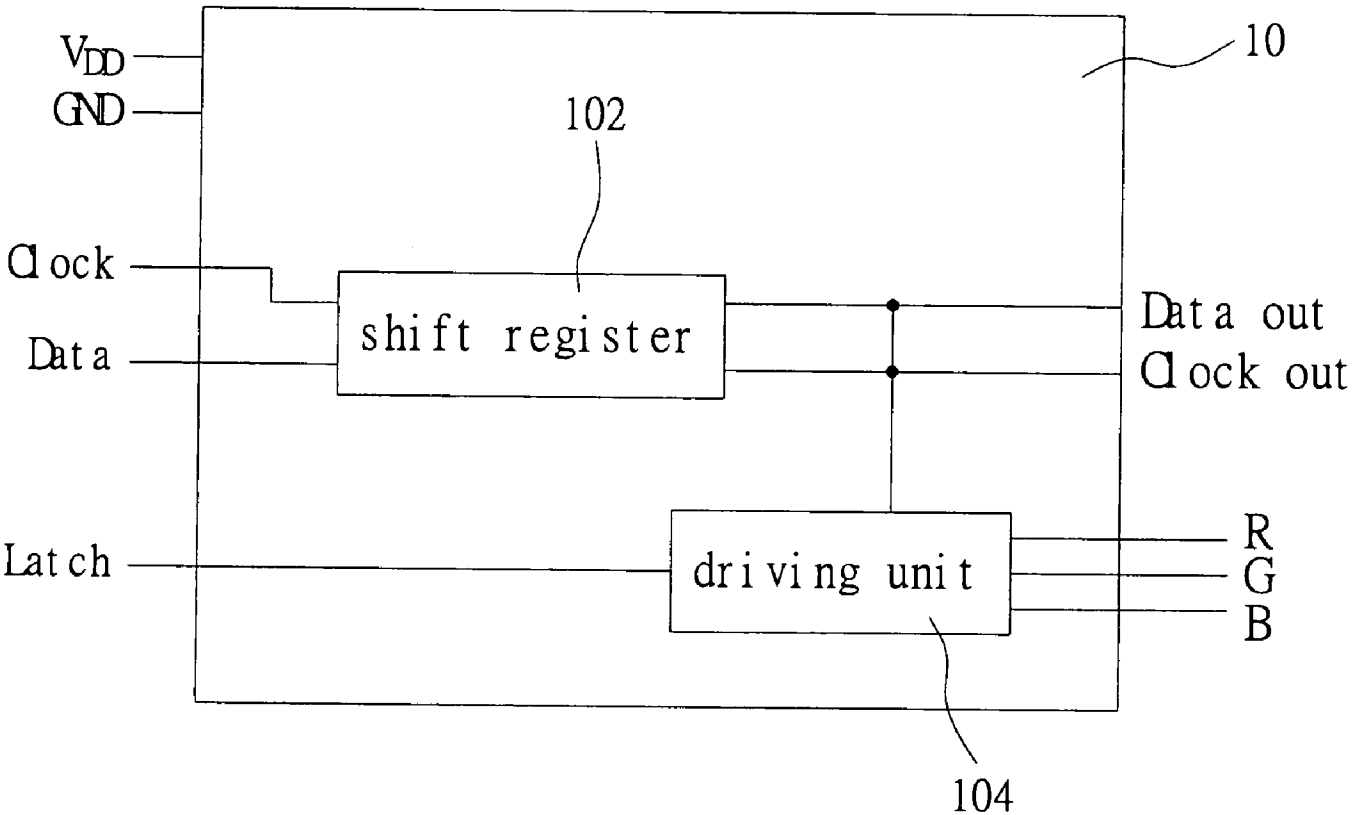
FIG 1 PRIOR ART
FIG. 1 is a circuit block diagram of an LED driving circuit of the prior art.
Figure 2:
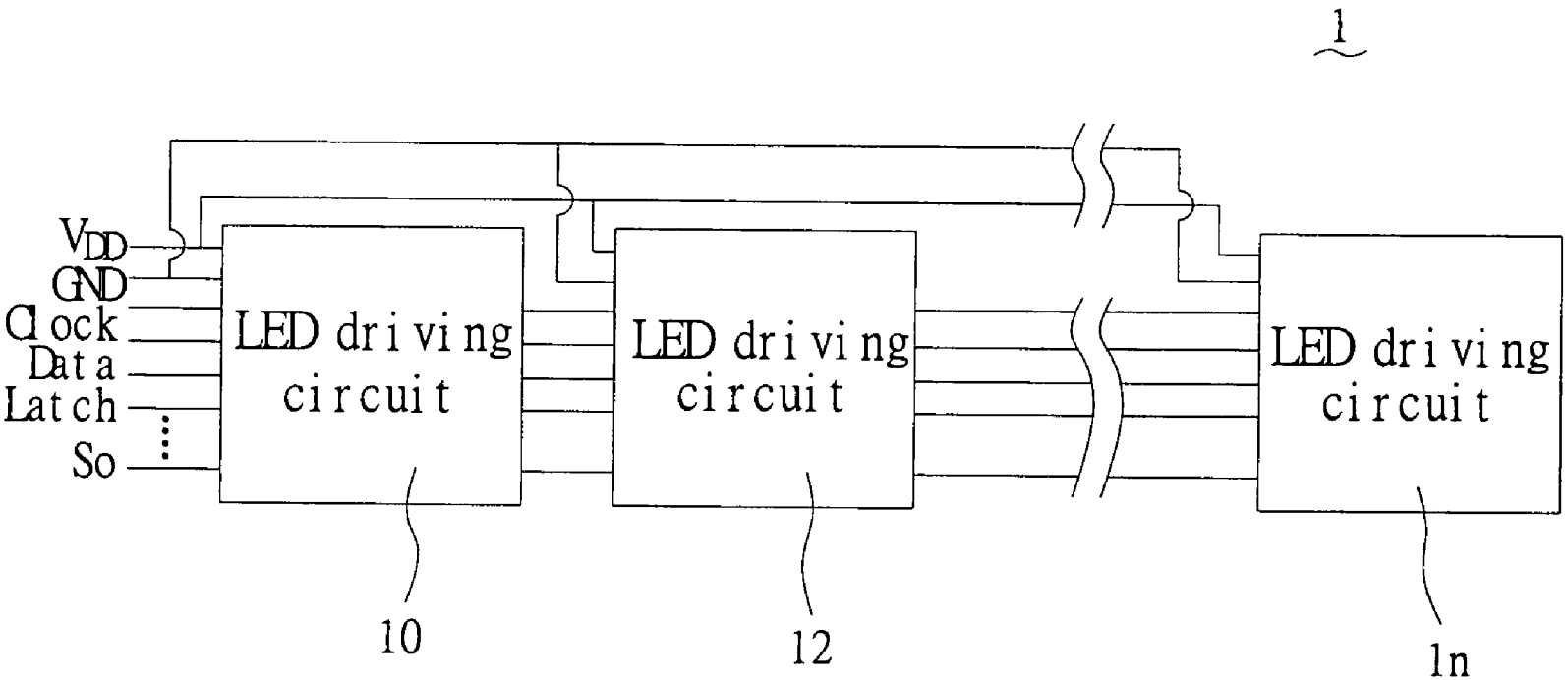
FIG 2 PRIOR ART
FIG. 2 is a block diagram of a serial LED illumination system of the prior art.
Figure 3:
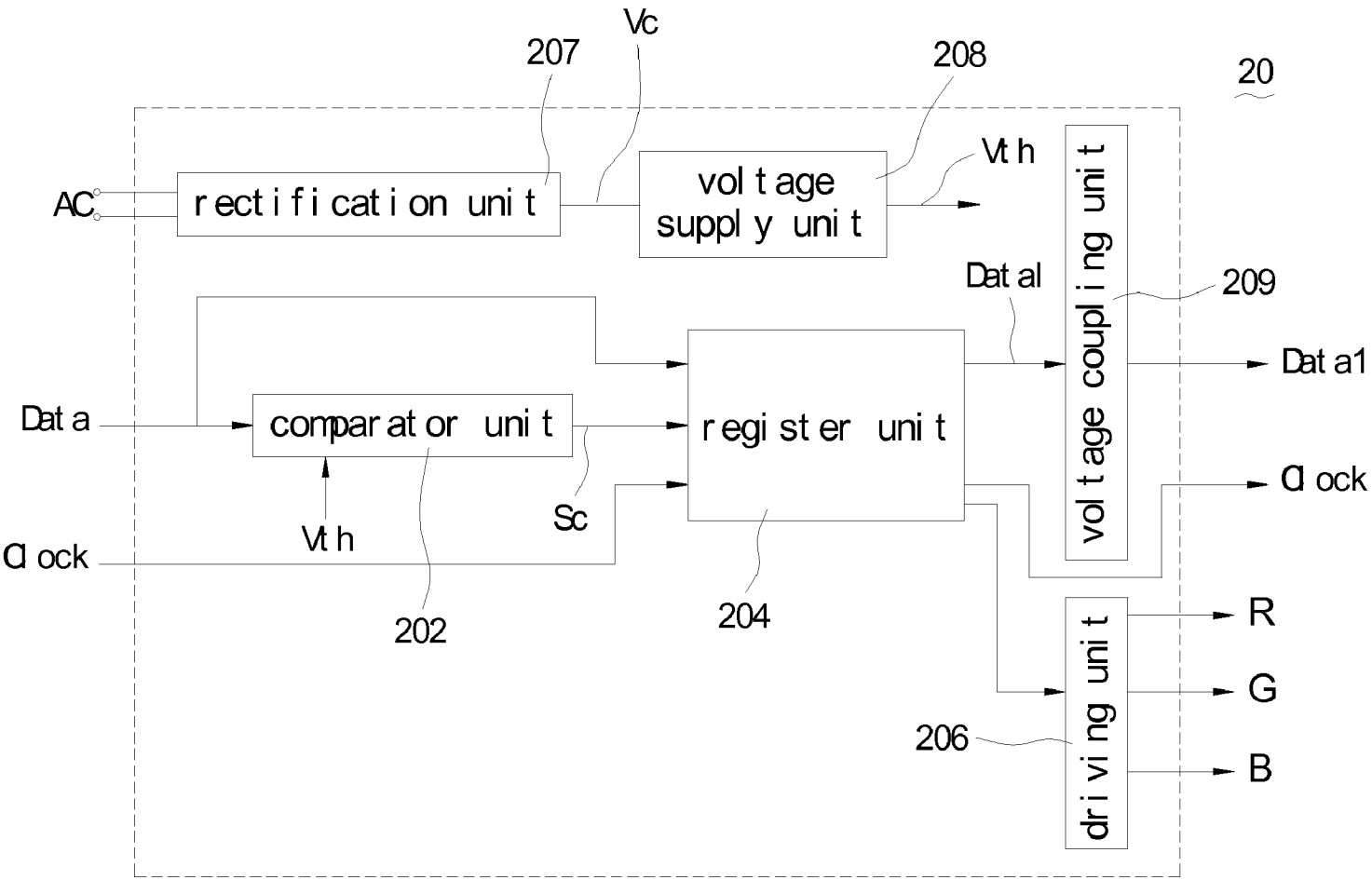
FIG. 3 is a circuit block diagram of an LED driving circuit of the present invention.

Reference is made to FIG. 3, which shows a circuit block diagram of an LED driving circuit of the present invention. The LED driving circuit 20 receives a data signal Data according to a clock signal Clock. The LED driving circuit 20 includes a comparator unit 202, a register unit 204, and a driving unit 206.

Figure 4:
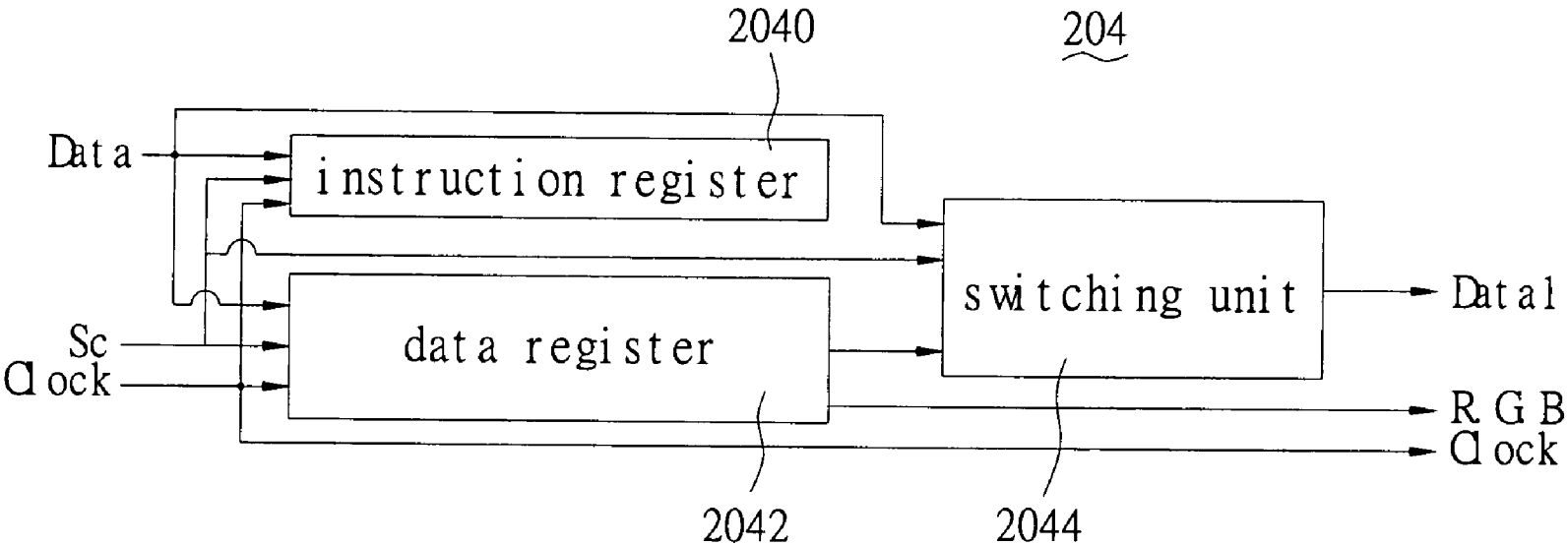
FIG. 4 is a block diagram of the register unit of the present invention.

The comparator unit 202 has at least one voltage threshold. The comparator unit 202 compares the data signal Data with the voltage thresholds so as to output a mode selection signal Sc. The data signal Data is an instruction data or an illumination display data. FIG. 4 shows a block diagram of the register unit of the present invention. The register unit 204 includes an instruction register 2040 and a data register 2042. The register unit 204 is coupled to the comparator unit 202. The register unit 204 is controlled by the mode selection signal Sc so as to perform an instruction mode or a data transmission mode according to a clock signal Clock. The instruction can be a latch instruction, a read back instruction, or an address instruction.

The instruction register 2040 stores the instruction data under the instruction mode. The data register 2042 stores the illumination display data under the data transmission mode. When the data register 2042 is full, the register unit 204 outputs a secondary data signal Data1. The driving unit 206 is coupled with the register unit 204. The driving unit 206 is controlled by the instruction data and drives an LED module (not shown in the figure) according to the illumination display data. The LED module is a full color LED.

Please refer to FIG. 4 and FIG. 3. The LED driving circuit 20 uses the comparator unit 20 to receive the data signal Data. When the data signal Data is an instruction data, the level of the data signal Data is larger than the voltage threshold of the comparator unit 202. Next, the LED driving circuit 20 performs the instruction mode to execute the latch instruction, the read back instruction, or the address instruction. When the LED driving circuit 20 performs the latch instruction, the driving unit 206 is controlled by the latch instruction and drives the full color LED according to the illumination display data stored in the data register 2042. When the LED driving circuit 20 performs the read back instruction, the illumination display data stored in the data register 2042 is red back via a controller (not shown in the figure). When the LED driving circuit 20 performs the address instruction, the address of the register unit is set and is controlled by the controller.

When the data signal Data is an illumination display data, the level of the data signal Data is smaller than the voltage threshold of the comparator unit 202. Next, the LED driving circuit 20 operates in the data transmission mode to save and transmit the data.

Please refer to FIG. 3. The LED driving circuit further includes a rectification unit 207. The rectification unit 207 receives an AC and outputs a DC Vc. The AC is alternating square current voltage. The LED driving circuit further includes a voltage supply unit 208 coupled to the rectification unit 207. The voltage supply unit 208 outputs the voltage thresholds according to the DC Vc. The LED driving circuit further includes a voltage coupling unit 209 coupled to the register unit 104. The voltage coupling unit 209 receives the secondary data signal Data1 and adjusts the voltage level of the secondary data signal Data1 so that the voltage level of the secondary data signal Data1 is equal to the voltage threshold of the data signal Data.

Please refer to FIG. 4. The register unit 204 further includes a switching unit 2044. The switching unit 2044 is coupled to the data register 2042 and receives the illumination display data. When the data register 2042 is full, the switching unit 2044 outputs the secondary data signal data1 to a next LED driving circuit (not shown in the figure).

Figure 5:
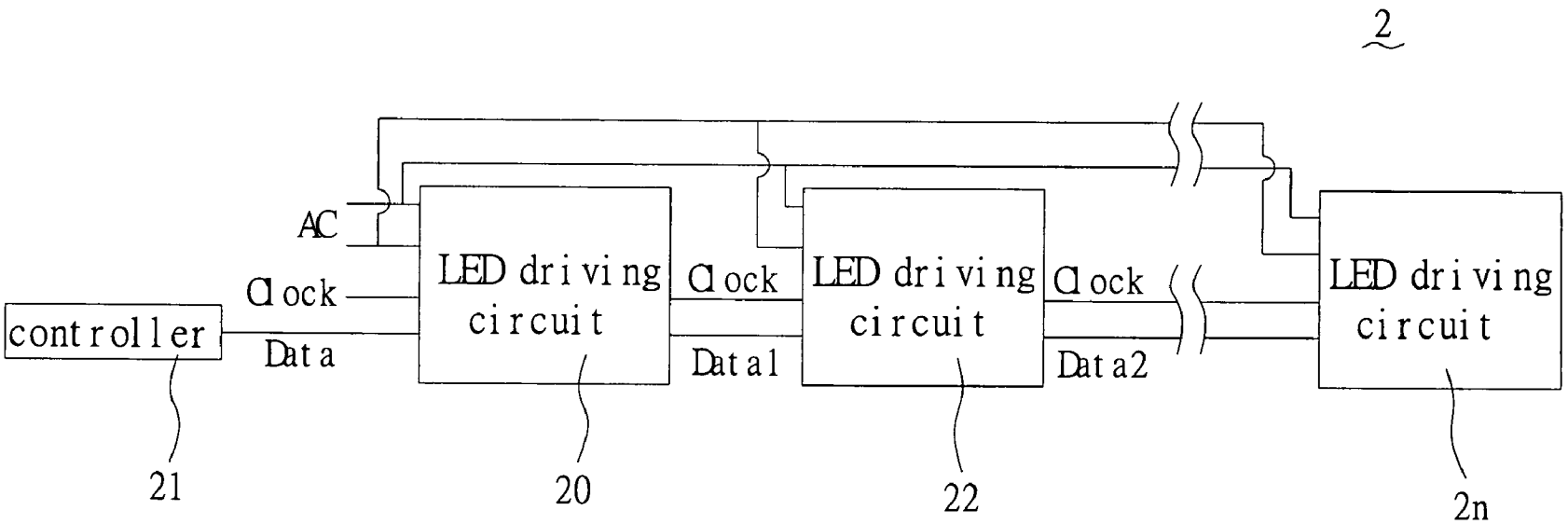
FIG. 5 is a block diagram of a serial LED illumination system of the present invention.

Reference is made to FIG. 5, which shows a block diagram of a serial LED illumination system of the present invention. The serial LED illumination system 2 is composed of a controller 21 and LED driving circuits 20, 22, **2*n* that are connected together. The controller 21 outputs a data signal Data. The data signal Data is an instruction data or an illumination display data. The LED driving circuits 20, 22, 2*n* are connected with each other in serial and coupled to the controller 21. The LED driving circuit 20, 22, 2*n* receives the data signal Data according to a clock signal Clock. When the serial LED illumination system 2 is operated in an instruction mode, the LED driving circuits 20, 22, 2*n* store the instruction data simultaneously via a parallel data transmission method. When the serial LED illumination system 2 is operated in a data transmission mode, the LED driving circuits 20, 22, 2*n* transmit a secondary data signal Data1** via a serial data transmission method.

Please refer to FIG. 5. In the serial LED illumination system 2 of the present invention, the LED driving circuits 20, 22, **2*n* are controlled by the instruction data outputted from the controller 21 to operate in the instruction mode simultaneously. On the other hand, the LED driving circuits 20, 22, 2*n* are controlled by the illumination display data outputted from the controller 21 to perform the data transmission mode in order. In the data transmission mode, the primary LED driving circuit 20 stores the illumination display data. When the data register 2042 of the primary LED driving circuit 20 is full, the switching unit in the primary LED driving circuit 20 is enabled to treat the illumination display data that is not stored as the secondary data signal Data1 and transmits the secondary data signal Data1 to the secondary LED driving circuit 22. The operating principle of the secondary LED driving circuit 22 is the same as that of the primary LED driving circuit 20. Thereby, when the serial LED illumination system 2 is operated in the data transmission mode, the serial LED illumination system 2 transmits the secondary data signal Data1** in order via a serial data transmission method.

The present invention provides an LED driving circuit and a serial LED illumination system using the same. The LED driving circuit used in the illumination system utilizes a rectification unit and a power supply unit as so to be operated in an AC, thereby avoiding supply voltage decay. The LED driving circuit uses the comparator to judge the inputted data signal. By increasing the number of the comparators in the LED driving circuit, the illumination system can add a new function without adding a new transmission line. The illumination system of the present invention is controlled by the controller to operate in the instruction mode or the data transmission mode. Thereby, the requirements of a variety of illumination display systems are achieved.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. An LED driving circuit, receiving a data signal according to a clock signal, comprising:

a rectification unit for receiving an AC and outputting a DC;

a voltage supply unit coupled to the rectification unit, outputting at least one voltage threshold according to the DC;

a comparator unit, receiving the one or more voltage thresholds, wherein the comparator unit compares the data signal with the voltage thresholds so as to output a mode selection signal, and the data signal is an instruction data or an illumination display data;

a register unit having an instruction register and a data register, wherein the register unit is coupled to the comparator unit, the register unit is controlled by the mode selection signal and performs an instruction mode or a data transmission mode according to the clock signal, and the instruction register stores the instruction data under the instruction mode and the data register stores the illumination display data under the data transmission mode, wherein, when the data register is full, the register unit outputs a secondary data signal;

a voltage coupling unit coupled to the register unit, for receiving the secondary data signal and adjusting the voltage level of the secondary data signal, so that the voltage level of the secondary data signal is equal to the voltage level of the data signal; and a driving unit coupled to the register unit, wherein the driving unit is controlled by the instruction data and drives an LED module according to the illumination display data.

2. The LED driving circuit as claimed in claim 1, wherein the AC is an alternating square current voltage.

3. The LED driving circuit as claimed in claim 1, further comprising a switching unit coupled to the data register and receiving the illumination display data, wherein, when the data register is full, the switching unit outputs the secondary data signal.

4. The LED driving circuit as claimed in claim 1, wherein the LED module is a full color LED.

5. The LED driving circuit as claimed in claim 1, wherein the instruction data is a latch instruction.

6. The LED driving circuit as claimed in claim 1, wherein the instruction data is a read back instruction.

7. The LED driving circuit as claimed in claim 1, wherein the instruction data is an address instruction.

8. A serial LED illumination system, comprising:

a rectification unit for receiving an AC and outputs a DC;

a voltage supply unit coupled to the rectification unit, wherein the voltage supply unit outputs at least one voltage threshold according to the DC;

a controller outputting a data signal, wherein the data signal is an instruction data or an illumination display data;

at least one LED driving circuit, wherein the LED driving circuits are connected with each other in serial and coupled to the controller, and the LED driving circuit receives the data signal according to a clock signal;

wherein the LED driving circuit comprises:

a comparator unit receiving the one or more voltage thresholds, wherein the comparator unit compares the data signal with the voltage thresholds so as to output a mode selection signal;

a register unit having an instruction register and a data register, wherein the register unit is coupled to the comparator unit, the register unit is controlled by the mode selection signal and performs an instruction mode or a data transmission mode according to the clock signal, and the instruction register stores the instruction data under the instruction mode and the data register stores the illumination display data under the data transmission mode, wherein when the data register is full, the register unit outputs a secondary data signal;

a voltage coupling unit coupled to the register unit, wherein the voltage coupling unit receives the secondary data signal and adjusts the voltage level of the secondary data signal so that the voltage level of the secondary data signal is equal to the voltage level of the data signal; and a driving unit coupled to the register unit, wherein the driving unit is controlled by the instruction data and drives an LED module according to the illumination display data;

thereby, when the serial LED illumination system is operated in an instruction mode, the LED driving circuits stores the instruction data simultaneously via a parallel data transmission method, and when the serial LED illumination system is operated in a data transmission mode, the LED driving circuits transmits a secondary data signal via a serial data transmission method.

9. The serial LED illumination system as claimed in claim 8, wherein the AC is an alternating square current voltage.

10. The serial LED illumination system as claimed in claim 8, wherein the register unit further comprises a switching unit coupled to the data register and receiving the illumination display data, wherein, when the data register is full, the switching unit outputs the secondary data signal.

11. The serial LED illumination system as claimed in claim 8, wherein the LED module is a full color LED.

12. The serial LED illumination system as claimed in claim 8, wherein the instruction data is a latch instruction.

13. The serial LED illumination system as claimed in claim 8, wherein the instruction data is a read back instruction.

14. The serial LED illumination system as claimed in claim 8, wherein the instruction data is an address instruction.

* * * * *